United States Patent [19]

van Wersch et al.

[11] Patent Number: 4,875,942

[45] Date of Patent: Oct. 24, 1989

[54] METHOD OF CLEANING RESIDUAL DYE MATERIAL FROM ROLLERS OF A TEXTILE FABRIC DRYING OVEN

[75] Inventors: Kurt van Wersch, Wegberg; Helge Freiberg, Monchen-Gladbach; Peter Mevissen, Erkelenz, all of Fed. Rep. of Germany

[73] Assignee: A. Monforts GmbH & Co., Fed. Rep. of Germany

[21] Appl. No.: 226,284

[22] Filed: Jul. 29, 1988

[30] Foreign Application Priority Data

Jul. 31, 1987 [DE] Fed. Rep. of Germany ..... 3725419

[51] Int. Cl.[4] ..... B08B 1/02

[52] U.S. Cl. ..... 134/15; 134/251; 134/32; 162/199; 15/248 A

[58] Field of Search ..... 134/15, 18, 25.1, 32; 162/199; 15/302, 306 A, 248 A; 8/137

[56] References Cited

U.S. PATENT DOCUMENTS

| | | | |
|---|---|---|---|
| 2,753,592 | 7/1956 | Cochran | 134/15 |
| 3,298,904 | 1/1987 | Compote, Jr. | 134/15 |
| 4,116,762 | 9/1978 | Gardiner et al. | 134/15 |
| 4,804,420 | 2/1989 | Johnson et al. | 134/21 |

*Primary Examiner*—Helen M. S. Sneed
*Assistant Examiner*—Sharon T. Cohen
*Attorney, Agent, or Firm*—Shefte, Pinckney & Sawyer

[57] ABSTRACT

A method of cleaning residual dye material from rollers of a textile fabric drying oven during passage of a travelling cloth lead therethrough. The method involves applying a cleaning material to the travelling cloth lead in advance of the oven and rotating the rollers to be cleaned at a surface speed different from the surface speed of the cloth lead to cause a cleaning action of the cloth lead against the rollers. The change in roller speed can be accomplished progressively, either by acceleration or deceleration and can be accomplished on the rollers individually or in sets.

10 Claims, 1 Drawing Sheet

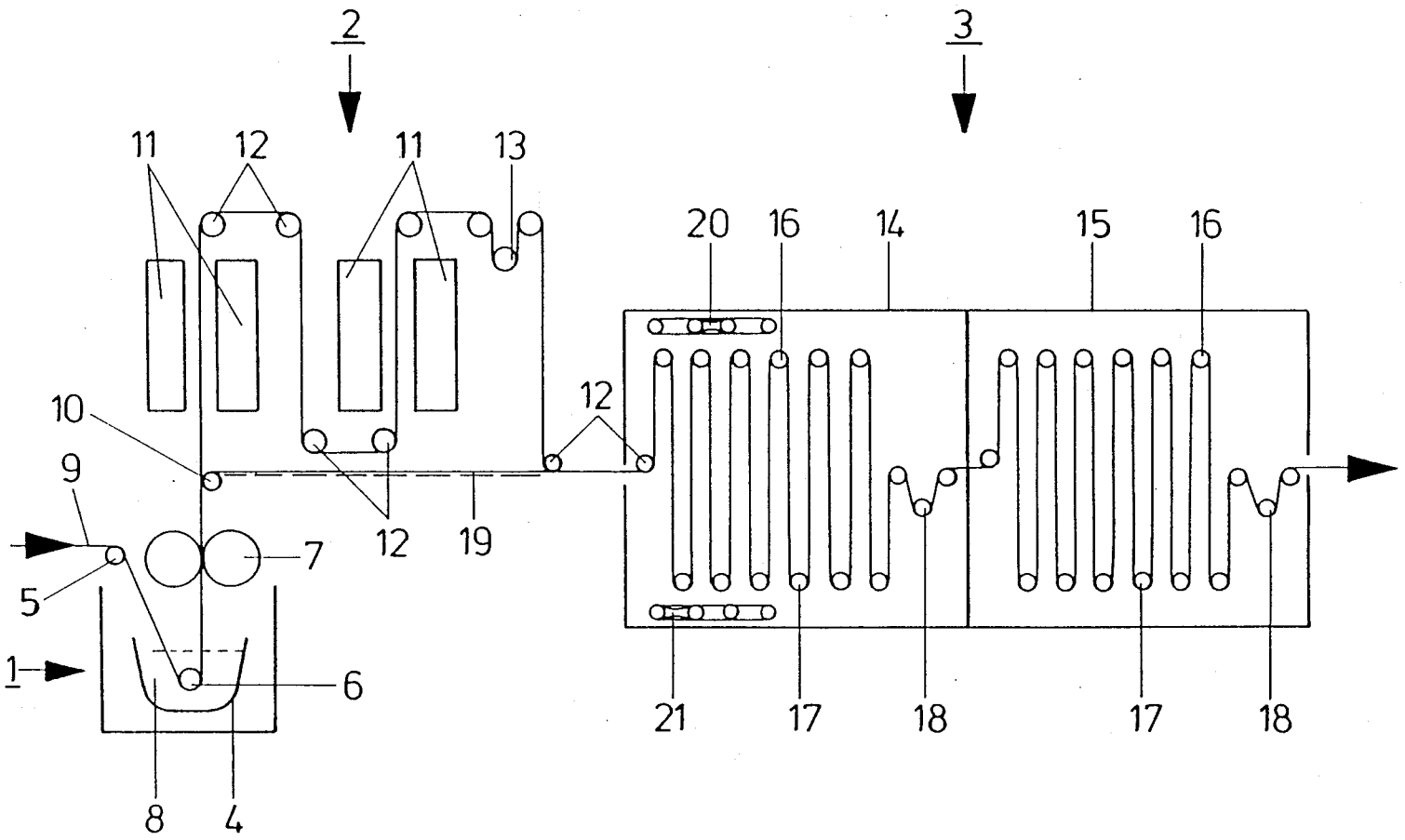
1
2
3
4
5
6
7
8
9
10
11
12
13
14
15
16
17
18
19
20
21

METHOD OF CLEANING RESIDUAL DYE MATERIAL FROM ROLLERS OF A TEXTILE FABRIC DRYING OVEN

BACKGROUND OF THE INVENTION

The present invention relates to a method of cleaning residual dye material from rollers of a textile fabric drying oven, and more particularly to such a method performed during passage of a traveling cloth lead therethrough.

In conventional oven drying of fabrics in a dyeing range it is common for the rollers over which the wet or moist fabric passes before the fabric is substantially dry to have dye material from the fabric deposited on the rollers. This deposition results from the fabric being more or less wet from the liquor application. The degree of residual moisture, and therefore the degree of dye deposition as well as the number of rollers on which the deposition occurs, depends on the pretreatment, including squeezing, and any preliminary drying. For example, if the dye is applied to the fabric in a padder and then squeezed, the residual moisture at the discharge of the squeezing unit may be in the range of between 40% and 100% depending on the material and the type and extent of treatment, on the other hand, if the dyeing oven is preceded by an infrared preliminary dryer, a residual moisture in the range of approximately 20% to 40% may be common. Deposition of dye material from the fabric onto the rollers generally ceases at the point in the oven where the moisture in the fabric has been decreased to below about 5% to 20% depending on the type of fabric material, dye and dye liquor.

The manner in which the dye liquor, particularly aqueous, is applied to the fabric is not pertinent to the present invention. Any kind of dye liquor application or equipment can be used, for example, a padder, a sprayer, a foam applicator or a low liquor ratio applicator, the latter being of particular use for applying dye to one side of a fabric.

When the color or type of dye material to be applied is changed from one run to the next, not only does the liquor applicator unit have to be cleaned but also the oven itself must be cleaned to remove residual dye material of the preceding dyeing from the rollers on which the material has been deposited. The conventional practice is for the individual rollers to be cleaned by an operator working from the side of the equipment in a manner that does not significantly disturb the threading of the cloth lead through the equipment. This is a tedious and time-consuming task not uncommonly requiring two or more hours.

To minimize the number of cleanings that must be performed, it is often the practice not to change colors or dyeing operations randomly. Rather, it is common to start dyeing cycles on a Monday, for example, with pale dyes and during the progress of the week change to increasingly darker dye applications. In this manner thorough cleaning of the rollers is not necessary until the end of the sequence of dye cycles and before a new cycle begins with pale dyes. However, this practice is not possible for dyeing operations where, as is often the case, priority of delivery and short notice orders prevent orderly planning of dyeing from pale to dark shades over an extended cycle period.

SUMMARY OF THE INVENTION

It is the purpose of the present invention to mechanize and automate the cleaning of the residual dye material from the rollers of an oven and at the same time accelerate the cleaning so that frequent dye changes can be made in a simple and practical manner even in small lots without concern for the sequencing of dye shades.

The purpose of the present invention is obtained by a method of cleaning residual dye material from rollers of a textile fabric drying oven during passage of a traveling cloth lead therethrough. In this method, cleaning material is applied to the traveling cloth lead in advance of the oven, and rotating the rollers to be cleaned at a surface speed different from the surface speed of the cloth lead to cause a cleaning action of the cloth lead against the rollers. The difference in surface speed may be obtained by faster or slower rotation of the rollers relative to the cloth lead, and the cleaning material may be clear water or water with additives, such as surfactants or solvents, although clear water is generally preferable.

The effect of the surface speed difference between the rollers and the cloth lead results in the roller being cleaned simply through their relative motion with respect to the cloth lead. The application of the cleaning material to the cloth lead can be efficiently accomplished in the dye liquor applicator, such as a padder, preceding the oven, during cleaning of the applicator itself. Thus the cleaning material for the applicator serves for wiping or washing the water-soluble particles of dye residue from the rollers of the oven. In this regard, he moisture of the cloth lead may be maintained somewhat wetter than the fabric material during treating, but the amount of moisture is preferably limited so that dripping does not occur.

Preferably, the rotating of the rollers at a surface speed different from the surface speed of the cloth lead is a progressive changing of the surface speed of rotation with respect to the surface speed of the cloth, such as an acceleration or deceleration of the roller rotation. The changing in rotation can be performed by the rollers individually, by the rollers as a set, or by the rollers in sets. Furthermore, the rotating of the rollers at a different surface speed may be performed intermittently and/or may be regulated.

In drying ovens the rollers are usually arranged in vertical pairs with the fabric being trained first over a top roller and then a bottom roller. Usually the top rollers are driven. According to the present invention, it is a simple matter to vary the drive to the driven rollers to either increase or decrease the speed of the rollers. Preferably a brief, sudden and/or regulated change in the speed of rotation is performed so that the speed of the rollers change without significantly changing the speed of the cloth lead. For this reason, it is preferable that only individual rollers or a set or sets of rollers be changed in speed rather than changing the speed of all rollers.

Usually, the bottom rollers of the roller pairs are not driven and would require an additional drive for increasing the rotational speed according to the present invention. It is generally simpler, however, to apply a sudden and/or regulated braking of the individual rollers or sets of rollers to accomplish the purpose of the present invention. All that is needed for braking of this type is to apply a brake band or a brake shoe or the like to the roller that is to be changed in rotational speed.

This braking to change speed can also be utilized to change the speed of the top rollers. Thus, the present invention is carried out by an intermittent and/or regulated change in the roller speed to obtain a wiping off and an optimum cleaning effect on the rollers that is not significantly dependent on the type of dye material.

Other features and advantages of the present invention will be apparent from the accompanying drawings and following description of the preferred embodiment.

BRIEF DESCRIPTION OF THE DRAWING

The accompanying drawing is a schematic illustration of a textile fabric drying range in which the preferred embodiment of the method of cleaning method dye material from rollers according to the preferred embodiment of the present invention is incorporated.

DETAILED DESCRIPTION OF THE PREFERRED EMBODIMENT

In the accompanying drawing, the dyeing range in which the method of the present invention is practiced is illustrated as including a dye liquor applicator 1, a preliminary dryer 2 and an oven 3. The dye liquor applicator 1 in the illustrated embodiment is in the form of a padder with a padding trough 4, a guide roller 5 above the trough 4, an immersion roller 6 within the trough 4, and a squeeze roll unit 7 above the trough 4. The trough 4 normally contains a dye liquor or other liquid applicating material 8. During dyeing operation of the equipment, the fabric web 9 to be dyed travels over the guide roller 5 and under the immersion roller 6 through the applicating material 8. The fabric web 9 with the dye material applied is squeezed as it passes through the squeeze roll unit 7 to remove sufficient moisture such that there is a residual moisture in the range of 30% to 100% by weight of the fabric depending on the type of fiber in the fabric. The fabric web 9 then travels over a guide roller 10 and directly into the oven 3 or through the infrared preliminary dryer 2 preceding the oven 3. In the preliminary dryer 2, the fabric web 9 travels between pairs of infrared heaters (11) and is dried to a residual moisture content at the outlet of about 20% to 40%. From the preliminary dryer 2, the fabric web is fed by drive roller 13 and further guide rollers 12 to the oven 3. The oven 3 has a row of top rollers 16 and a row of bottom rollers 17, with the top and bottom rollers arranged in pairs. The rollers are usually in two sequential chambers 14 and 15 with drive rollers 18 arranged at the end of each of the chambers 14 and 15.

As the fabric web progresses through the drying oven 3, the degree of moisture changes from wet to substantially dry. When it is wet, there is a tendency for some of the dye material to be deposited as residue on the rollers. After the fabric web has traveled through the oven and over a number of rollers it will be substantially dry and the dye material will not deposit onto the remainder of the rollers throughout the oven. The number of rollers 16 and 17 on which the dye material will be deposited will vary from application to application depending on the type of fabric, type of fiber in the fabric and type of pretreatment. However, the rollers that have received a deposit of dye residue must be cleaned, for example, by washing, before a dye change can be implemented. Usually, such cleaning is necessary for only the rollers in the first chamber 14 as drying has usually advanced enough by the time the fabric is in the second chamber 15 that residue deposit does not occur.

To provide for continuous operation without rethreading of fabric through the dye range at each cycle change, a cloth lead is sewn between the end of the first fabric and the leading end of the subsequent fabric.

When there is a change from dye lot to dye lot, such as a change in the color of the dye material, all components of the applicator 1 must be cleaned. For this purpose, the dye liquor 8 is first drained from the trough 4 and replaced with a cleaning material, preferably clear water. This will result in cleaning of the trough 4, immersion roller 6, and squeeze roller unit 7. During this cleaning, the applicator 1 will be traversed, not by a fabric web to be treated, but by the cloth lead. This cloth lead is thereby saturated with the water and squeezed in the squeeze roll unit 7 to a desired moisture content that is generally slightly more than the moisture content in the fabric during a dyeing cycle. The wet cloth lead then travels in the same manner as the fabric web 9 during dyeing through the preliminary dryer 2 or by-passes the preliminary dryer along the alternative path 19 to the oven 3 and finally in the oven over all top and bottom rollers 16 and 17.

According to the present invention, the top and bottom rollers 16 and 17, and, if desired, the preceding guide rollers 10, 12, 13 are rotated at a different surface speed than the speed of the cloth lead, either individually or as a set or sets. In the embodiment illustrated, the change in speed is accomplished by brake bands 20 and 21 applied to the rollers individually or in sets. These brake bands 20, 21 need be applied only to those rollers on which it is expected that residual dye material has been deposited.

In the manner described, the cloth lead acts on the rollers to dislodge and remove residual dye material without manual effort to clean the rollers so that the oven is ready for the next drying operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangement, the present invention being limited only by the claims appended thereto and the equivalents thereof.

We claim:

1. A method of cleaning residual dye material from rollers of a textile fabric drying oven during passage of a traveling cloth lead therethrough, said method comprising applying a cleaning material to said traveling cloth lead in advance of the oven and rotating rollers to be cleaned at a surface speed different from the surface speed of the cloth lead to cause a cleaning action of the cloth lead against the rollers.

2. A method of cleaning residual dye material from rollers of a textile drying oven according to claim 1 and characterized further in that said rotating of the rollers at a surface speed different from the surface speed of the cloth lead is a progressive changing of the surface speed of rotation with respect to the surface speed of the cloth.

3. A method of cleaning residual dye material from rollers of a textile drying oven according to claim 2 and characterized further in that said progressive changing is an acceleration.

4. A method of cleaning residual dye material from rollers of a textile drying oven according to claim 2 and characterized further in that said progressive changing is a deceleration.

5. A method of cleaning residual dye material from rollers of a textile drying oven according to claim 1 and characterized further in that said applying a cleaning material comprises passing the cloth lead through a liquor applicator containing liquid cleaning material.

6. A method of cleaning residual dye material from rollers of a textile drying oven according to claim 1 and characterized further in that said rotating of rollers comprises rotating rollers individually at a surface speed different from the surface speed of the cloth lead.

7. A method of cleaning residual dye material from rollers of a textile drying oven according to claim 1 and characterized further in that said rotating of rollers comprises rotating a set of rollers at a surface speed different from the surface speed of the cloth lead.

8. A method of cleaning residual dye material from rollers of a textile drying oven according to claim 1 and characterized further in that said rotating of rollers comprises rotating rollers in sets at surface speeds different from the surface speed of the cloth lead.

9. A method of cleaning residual dye material from rollers of a textile drying oven according to claims 1, 2, 3, 4, 6, 7 or 8 and characterized further in that said rotating of rollers at a different surface speed is performed intermittently.

10. A method of cleaning residual dye material from rollers of a textile drying oven according to claims 1, 2, 3, 4, 6, 7 or 8 and characterized further in that said rotating of rollers at a different surface speed is controlled.

* * * * *